US006765431B1

(12) United States Patent
Coady

(10) Patent No.: US 6,765,431 B1
(45) Date of Patent: Jul. 20, 2004

(54) LOW NOISE BANDGAP REFERENCES

(75) Inventor: Edmond Patrick Coady, Colorado Springs, CO (US)

(73) Assignee: Maxim Integrated Products, Inc., Sunnyvale, CA (US)

( * ) Notice: Subject to any disclaimer, the term of this patent is extended or adjusted under 35 U.S.C. 154(b) by 0 days.

(21) Appl. No.: 10/270,865

(22) Filed: Oct. 15, 2002

(51) Int. Cl.[7] ..... G05F 3/02
(52) U.S. Cl. ..... 327/539; 327/313
(58) Field of Search ..... 327/539, 65, 89, 327/563; 323/313

(56) References Cited

U.S. PATENT DOCUMENTS

| | | | | |
|---|---|---|---|---|
| 3,617,859 A | | 11/1971 | Dobkin et al. | |
| 4,249,122 A | | 2/1981 | Widlar | |
| 4,346,344 A | | 8/1982 | Blauschild | |
| 4,896,094 A | | 1/1990 | Greaves et al. | |
| 5,541,538 A | * | 7/1996 | Bacrania et al. | 327/77 |
| 5,751,142 A | * | 5/1998 | Dosho et al. | 323/316 |
| 5,834,926 A | | 11/1998 | Kadanka | |
| 6,009,022 A | * | 12/1999 | Lee et al. | 365/189.09 |
| 6,175,224 B1 | | 1/2001 | Kadanka | |
| 6,218,822 B1 | | 4/2001 | MacQuigg | |
| 6,411,158 B1 | * | 6/2002 | Essig | 327/539 |
| 6,509,726 B1 | * | 1/2003 | Roh | 323/313 |
| 6,563,371 B2 | * | 5/2003 | Buckley et al. | 327/539 |
| 2002/0000843 A1 | * | 1/2002 | Lee | 327/66 |

* cited by examiner

*Primary Examiner*—Terry D. Cunningham
(74) *Attorney, Agent, or Firm*—Blakely, Sokoloff, Taylor & Zafman LLP

(57) ABSTRACT

Low noise bandgap references of the type providing a temperature independent output by balancing the proportional to absolute temperature dependence of the difference in base-emitter voltages of two transistors operating at different current densities with the negative temperature coefficient of the base-emitter voltage of a transistor. The bandgap references disclosed reduce the noise characteristic of such references by balancing the difference in base-emitter voltages of a first number of pairs of transistors, each pair having two transistors operating at different current densities, with the negative temperature coefficient of the base-emitter voltage of a second number of transistors, the second number being less than the first number. Various embodiments are disclosed, including embodiments having an output corresponding to the bandgap of the transistor material, and multiples of the bandgap of the transistor material.

22 Claims, 5 Drawing Sheets

LOW NOISE BANDGAP REFERENCES

BACKGROUND OF THE INVENTION

1. Field of the Invention

The present invention relates to the field of bandgap references.

2. Prior Art

Bandgap references are well known in the prior art, and are commonly used in integrated circuits to provide a reference that is independent of temperature. These references make use of two characteristics of the base-emitter voltage (VBE) of a bipolar transistor. In particular, the base-emitter voltage VBE of a junction transistor may be expressed as follows:

$$V_{BE} = V_{g0} + (V_{BE0} - V_{g0})\left(\frac{T}{T_0}\right) + \frac{NKT}{q}\ln\left(\frac{T_0}{T}\right) + \frac{KT}{q}\ln\left(\frac{I_C}{I_{C0}}\right)$$

where:

T=temperature $I_C$=the transistor collector current $I_{C0}$=collector current for which $V_{BEO}$ was determined $V_{g0}$=bandgap voltage of silicon at temperature $T_0$ $V_{BE0}$=base to emitter voltage V at $T_0$ and $I_{CO}$ q=electron charge N=structure factor K=Boltzmann's constant The dominant terms are the first two terms:

$$V_{g0} + (V_{BE0} - V_{g0})\left(\frac{T}{T_0}\right)$$

and since $V_{g0}$ is larger than $V_{BE0}$, the net result is a negative temperature coefficient for the VBE of a transistor.

If one subtracts the VBEs of two identical transistors $Q_1$ and $Q_2$ operating with unequal collector currents, there results:

$$V_{BE1} - V_{BE2} = \frac{KT}{q}\ln\left(\frac{I_{C1}}{I_{C0}}\right) - \frac{KT}{q}\ln\left(\frac{I_{C2}}{I_{C0}}\right)$$

or:

$$V_{BE1} - V_{BE2} = \frac{KT}{q}\ln\left(\frac{I_{C1}}{I_{C2}}\right)$$

This frequently is expressed in terms of current densities $J_1$ and $J_2$ in the two transistors as follows:

$$V_{BE1} - V_{BE2} = \frac{KT}{q}\ln\left(\frac{J_1}{J_2}\right)$$

or for transistors that are of different areas (area ratio of 1 to n) but otherwise identical and having the same collector currents, can be expressed in terms of the transistor areas A as follows:

$$V_{BE1} - V_{BE2} = \frac{KT}{q}\ln\left(\frac{A_2}{A_1}\right) = \frac{KT}{q}\ln(n)$$

In bandgap references, two transistors are usually operated at different current densities, typically by using two transistors of different areas, but having equal collector currents. Accordingly, for specificity in the descriptions to follow, it will be assumed that the respective two transistors have different areas and have substantially equal collector currents, though this is not a specific limitation of the invention, as transistors of the same area could be operated at different collector currents, or transistors of different areas could be operated at different collector currents in the practice of the present invention.

Now referring to FIG. 1, a circuit diagram for a classic bandgap reference may be seen. In such a circuit, resistors R2 and R3 could be equal resistors with amplifier A1, preferably a high input impedance amplifier, driving the output voltage VBG to the voltage required to provide a zero differential input to the amplifier. Accordingly, under these conditions, the currents through resistors R2 and R3 are equal currents, and accordingly, neglecting the base currents of transistors Q1 and Q2, provide equal collector currents to transistors Q1 and Q2. In such a circuit, transistor Q2 could have an area n times the area of transistor Q1, so that the current density in transistor Q2 is only 1/n times the current density in transistor Q1.

Amplifier A1 forces the collector voltages of transistors Q1 and Q2 to be equal. Because the collector voltages are equal, the voltage $V_{R1}$ across resistor R1 is as follows:

$$V_{R1} = VBE_{q1} - VBE_{q2}$$

Where:

$VBE_{q1}$ is the base emitter voltage of transistor Q1, and $VBE_{q2}$ is the base emitter voltage of transistor Q2

Referring back to the prior equations, it may be seen that the difference in these two VBE'S, the voltage across resistor R1, is proportional to absolute temperature. Also, since the current in resistor R2 equals the current in resistor R1, the voltage across resistor R2 is also proportional to absolute temperature, and can be thought of as amplifying the voltage across resistor R1 by a factor of (R1+R2)/R1.

In addition to the voltages proportional to absolute temperature (PTAT) across resistors R1 and R2, that leg of the circuit also includes the base emitter voltage VBE of transistor Q2. Again, referring to the prior equations, the VBE of a transistor linearly decreases with increases in temperature. Accordingly, by proper selection of the value of resistor R2 in relation to the value of resistor R1, the linear rate of increase in the PTAT voltage across the combination of resistors R1 and R2 with temperature increase may be made to equal the linear rate of decrease of the base emitter voltage $V_{BE}$ of transistor Q2 with temperature increases, so that the bandgap voltage output of the circuit VBG is substantially temperature insensitive.

In typical prior art bandgap references, the area ratio for transistors Q1 and Q2 may be, by way of example, on the order of 10 to 1, which area ratio will provide a VBE difference, the voltage across resistor R1, on the order of 60 millivolts. The output voltage of the bandgap reference needed to balance the positive temperature coefficient of the voltage across resistors R1 and R2 with the negative temperature coefficient of the VBE of transistor Q2 for a silicon transistor is typically a little over 1.2 volts. Accordingly, resistor R2 typically is approximately an order of magnitude larger in resistance than resistor R1.

The resistor R2 effectively amplifies the voltage across resistor R1, including the noise across resistor R1. In a typical bandgap reference circuit, resistor R1 is the single largest source of wideband noise. The noise across resistor R1 includes not only the thermal noise of resistor R1, but also the shot noise of transistors Q1 and Q2, and for that matter, the noise associated with the base resistance of transistors Q1 and Q2.

In electronic systems, the voltage reference provides the known standard that the rest of the system relies upon. Electronic circuit noise present in voltage references can limit the overall accuracy and ultimately the usefulness of the reference. Previous methods of reducing noise have depended on increased circuit power consumption or expensive semiconductor process development. The present invention improves the noise performance of bandgap references using a new circuit arrangement with existing process technology.

BRIEF SUMMARY OF THE INVENTION

Low noise bandgap references of the type providing a temperature independent output by balancing the proportional to absolute temperature dependence of the difference in base-emitter voltages of two transistors operating at different current densities with the negative temperature coefficient of the base-emitter voltage of a transistor are disclosed. The bandgap references disclosed reduce the noise characteristic of such references by balancing the difference in base-emitter voltages of a first number of pairs of transistors, each pair having two transistors operating at different current densities, with the negative temperature coefficient of the base-emitter voltage of a second number of transistors, the second number being less than the first number. Various embodiments are disclosed, including embodiments having an output corresponding to the bandgap of the transistor material (silicon in the exemplary embodiment), and multiples of the bandgap of the transistor material.

DETAILED DESCRIPTION OF THE PREFERRED EMBODIMENTS

Figure 2:
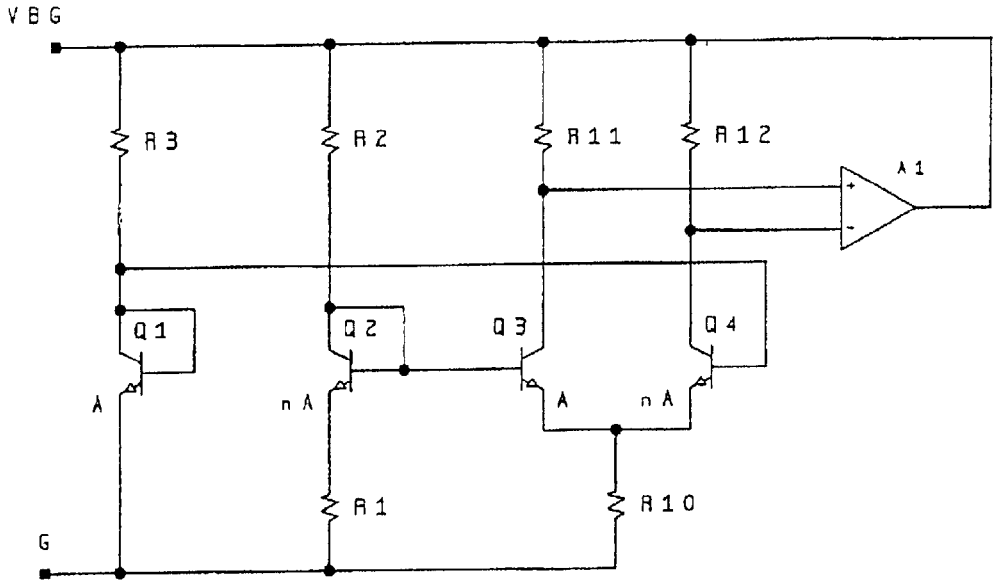
FIG. 2 is a circuit diagram for an exemplary embodiment of the present invention.

Now referring to FIG. 2, a circuit diagram for one embodiment of the present invention may be seen. Again for purposes of specificity and not for purposes of limitation, it will be assumed that different current densities are obtained in any respective pair of transistors by providing equal (or substantially equal) collector currents to transistors of different sizes. Thus, for instance in FIG. 2, the resistance of resistor R3 could be equal-to the value of resistor R2, and resistor R11 could be equal to resistor R12. Similarly, transistor Q2 could be n times the area of transistor Q1 and transistor Q4 could be n times the area of transistor Q3. Further, for convenience, the resistance of resistor R3 and resistor R2 could each equal the resistance of each of resistors R11 and R12. Alternatively, there is a benefit in making R11 and R12 relatively large, in that it increases the gain of transistors Q3 and Q4. Any noise from the operational amplifier A1 has to be referred back through this gain. Therefore the higher gain reduces the noise contribution of the amplifier, which eases the design constraints on the amplifier. Resistor R10 might be one half of resistor R1, transistors Q1 and Q3 could be identical, and transistors Q2 and Q4 also could be identical. Further, while transistor Q2 in FIG. 2 is shown as n times the area of transistor Q1, as is transistor Q4 relative to transistor Q3, the ratio of the areas between transistors Q4 and Q3 need not be the same as the ratio of the areas between transistors Q2 and Q1.

Because transistors Q1 and Q2 are diode connected, the base and the collector of each respective transistor are at the same voltage. Accordingly, one may write the equation for the voltages around the closed loop that includes resistor R1 as follows:

$$V_{R1}+VBE_{Q2}-VBE_{Q3}+VBE_{Q4}-VBE_{Q1}=0$$

or:

$$V_{R1}=(VBE_{Q1}-VBE_{Q2})+(VBE_{Q3}-VBE_{Q4})$$

Consequently, with the relative values of resistors and transistors previously mentioned:

$$(VBE_{Q1}-VBE_{Q2})=(VBE_{Q3}-VBE_{Q4})=\frac{KT}{q}\ln\left(\frac{A_2}{A_1}\right)=\frac{KT}{q}\ln(n)$$

and:

$$V_{R1}=2\frac{KT}{q}\ln(n)=\frac{KT}{q}\ln(n^2)$$

Figure 1:
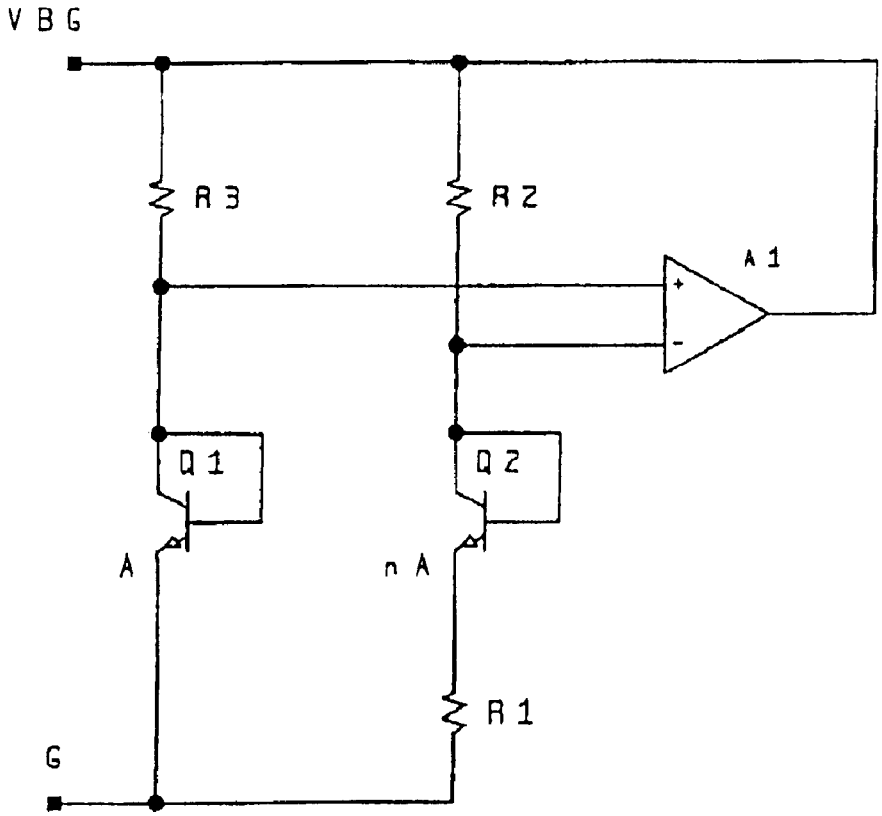
FIGURE 1 (Prior Art)
FIG. 1 is a circuit diagram for a prior art band gap reference.

It may be seen from the foregoing that the voltage across the resistor R1 is now equal to two differences in VBEs, or under the conditions stated, equivalent to the difference in one pair of VBEs for transistors having an area ratio of $n^2$ instead of simply n. Because the PTAT voltage across resistor R1 is now effectively twice the voltage across resistor R1 of the prior art bandgap reference of FIG. 1, the thermal noise voltage due to R1 is increased by $\sqrt{2}$ (because it's resistance is doubled to maintain the same current in Q2 & Q1). However, the amplification required by resistor R2 is reduced by a factor of more than 2, so the net result of the circuit of FIG. 2 is a reduction in the noise in the output voltage VBG of more than $1/\sqrt{2}$ times the noise voltage characteristic of the prior art. Also, the noise contribution due to the base resistance and shot noise of Q1 and Q2 is reduced by slightly greater than a factor of 2 because this noise appears across R1 and the amplification factor has been reduced. This noise reduction is partially offset by the additional noise contributed by Q3 and Q4.

The output voltage VBG itself, a voltage independent of temperature, is the same as that of the prior art (approximately 1.2 volts). In particular, as in the prior art, there is only a single VBE (with the associated negative temperature coefficient) which must be balanced by the PTAT voltages across resistors R1 and R2 that yield the temperature independence of the bandgap reference output voltage VBG.

Referring again to FIG. 2, it will be noted that for the values stated, amplifier A1 forces the collector currents in transistors Q3 and Q4 to be equal. Since the emitter voltages of transistors Q3 and Q4 are equal, the base voltages of transistors Q3 and Q4, and thus the collector voltages of transistors Q1 and Q2, differ by $VBE_{Q4}-VBE_{Q3}$. Consequently, even with the resistance of resistor R3 equaling the resistance of resistor R2, the collector currents of transistors Q1 and Q2 are not exactly equal. However the difference in the VBEs is on the order of 60 millivolts, whereas the voltage across the collector resistors is on the order of 0.5 volts. Accordingly, the collector currents are approximately equal, and the current densities in transistors Q1 and Q2 are approximately n to 1 under the stated exemplary assumptions.

In addition to reducing the noise in the bandgap output, another benefit of this circuit configuration is that the tail current of transistors Q3 and Q4 is self-biased by appropriate selection of resistor R10. In other circuit implementations, it would often be necessary to use an active current source to bias the transistor pair, which generally would contribute more noise that this simple resistor biasing scheme.

The present invention provides substantial flexibility with respect to noise reduction. Because transistors Q1 and Q2 are diode connected, their flicker noise contribution to the circuit is reduced. Therefore the primary source of flicker noise will be from transistors Q3 and Q4, primarily transistor Q3. On the other hand, the primary source of wideband noise is resistor R1. Thus the design tradeoff between flicker noise and wideband noise has been substantially decoupled. Consequently, the present invention allows operation of the left side of the circuit, which dominates wide band noise, at higher current to keep the wideband noise low, and the right side of the circuit, which dominates flicker noise, at a lower current to reduce the flicker noise. Lowering the current in transistors Q3 and Q4 too low, however, will cause the shot noise from these transistors to become significant contributions to the overall noise. Still, normally it is preferable to operate the left side of the circuit at a higher current than the right side.

Figure 3:
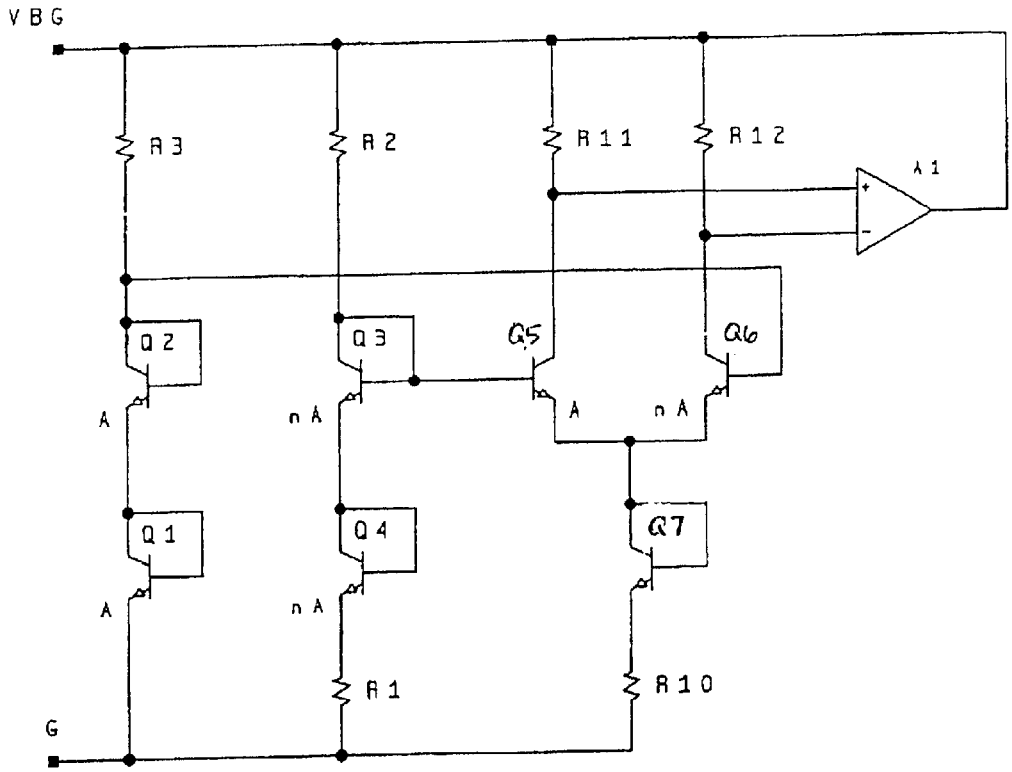
FIG. 3 is a circuit diagram for a first alternate embodiment of the present invention.

Now referring to FIG. 3, an alternate embodiment of the present invention may be seen. Again, while not a limitation of the invention, for convenience in explanation, one selection of the various components shown therein could be to make resistor R2, resistor R3, resistor R11 and resistor R12 all equal, to make transistors Q1, Q2, and Q5 identical, to make transistors Q3, Q4, Q6, and Q7 identical, each with an area equal to n times the area of each of transistors Q1, Q2, and Q5, and to make resistor R10 one third the value of resistor R1. As with the other embodiments and the prior art, amplifier A1 drives the output voltage VBG to a level required to make the collector voltages on transistors Q5 and Q6 equal. Looking at the closed loop, including the resistor R1, there results:

$$V_{R1}+VBE_{Q4}+VBE_{Q3}-VBE_{Q5}+VBE_{Q6}-VBE_{Q2}-VBE_{Q1}=0$$

or:

$$V_{R1}=(VBE_{Q2}-VBE_{Q3})+(VBE_{Q1}-VBE_{Q4})+(VBE_{Q5}-VBE_{Q6})$$

Consequently, with the relative values of resistors and transistors previously mentioned:

$$(VBE_{Q2}-VBE_{Q3})=(VBE_{Q1}-VBE_{Q4})=(VBE_{Q5}-VBE_{Q6})=\frac{KT}{q}\ln\left(\frac{A_2}{A_1}\right)=\frac{KT}{q}\ln(n)\text{ and:}$$

$$V_{R1}=3\frac{KT}{q}\ln(n)=\frac{KT}{q}\ln(n^3)$$

Thus it may be seen that in embodiment of FIG. 3, the voltage across the resistor R1 is increased to the difference in VBEs of three pairs of transistors having an area ratio of n to 1, which is equivalent to a single pair of transistors having an area ratio of $n^3$. Since the voltage across resistor R1 is increased over that of the prior art by a factor of 3, whereas the thermal noise of R1 will only be increased by $\sqrt{3}$ (because the resistance of R1 is tripled to maintain the same bandgap current), a further increase in the output to noise ratio across resistor R1 is achieved. Again, the noise contribution from shot noise and base resistance noise of Q1 and Q2 is reduced because the amplification factor between R1 and R2 has been reduced. However, in this embodiment, the circuit leg that includes resistor R1 also includes the VBE of two transistors, namely transistors Q3 and Q4, the temperature dependence of both of which must be cancelled by the PTAT voltages across resistors R1 and R2. The net result is that the bandgap reference output voltage VBG is doubled in comparison to that of the prior art of FIG. 1, or approximately 2.4 volts. Obviously this circuit requires greater headroom, though if the headroom is available, the output (VBG) to noise ratio is further improved. (The collector currents in transistors Q2 and Q3, etc. would only be approximately equal for the same reasons as given for transistors Q1 and Q2 of FIG. 2.)

Figure 4:
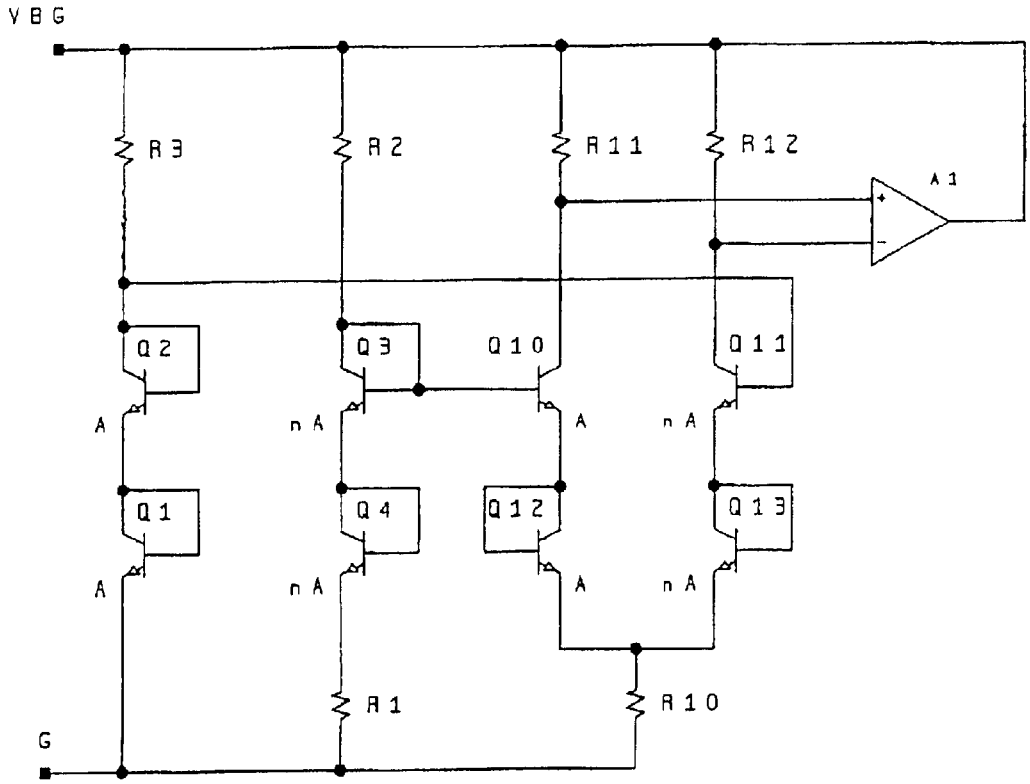
FIG. 4 is a circuit diagram for a second alternate embodiment of the present invention.

Now referring to FIG. 4, a still further embodiment of the present invention may be seen. Again, for purposes of explanation, it is convenient to consider the values of resistors R2, R3, R11 and R12 to all be equal, to set resistor R10 to be one-half that of resistor R1, to make transistors Q1, Q2, Q10, and Q12 identical transistors, and transistors Q3, Q4, Q11, and Q13 identical transistors each having an area n times the area of each of transistors Q1, Q2, Q10, and Q12. With amplifier A1 driving the bandgap reference voltage output VBG to that required to equalize the collector voltages and thus the collector currents in transistors Q10 and Q11, the voltages around the loop that includes resistor R1 is as follows:

$$V_{R1}+VBE_{Q4}+VBE_{Q3}-VBE_{Q10}-VBE_{Q12}+VBE_{Q13}+VBE_{Q11}-VBE_{Q2}-VBE_{Q1}=0$$

or:

$$V_{R1}=(VBE_{Q2}-VBE_{Q3})+(VBE_{Q1}-VBE_{Q4})+(VBE_{Q10}-VBE_{Q11})+(VBE_{Q12}-VBE_{Q13})$$

Consequently, with the relative values of resistors and transistors previously mentioned:

$$(VBE_{Q2}-VBE_{Q3})=(VBE_{Q1}-VBE_{Q4})=(VBE_{Q10}-VBE_{Q11}=(VBE_{Q12}-VBE_{Q13})=\frac{KT}{q}\ln\left(\frac{A_2}{A_1}\right)=\frac{KT}{q}\ln(n)\text{ and:}$$

$$V_{R1}=4\frac{KT}{q}\ln(n)=\frac{KT}{q}\ln(n^4)$$

Thus the embodiment of FIG. 4 provides a PTAT voltage across resistor R1 equivalent to the difference in VBEs of four transistor pairs, further increasing the output to noise ratio in the bandgap reference voltage VBG. Like the embodiment of FIG. 3, there are two VBEs in the leg of resistor R1, namely the VBEs of transistors Q3 and Q4, so that the bandgap reference output voltage VBG is again twice the voltage characteristic of the prior art bandgap reference of FIG. 1. Also, even with resistor R3 equaling resistor R2, the collector currents in transistors Q2 and Q3 are only approximately equal. Obviously resistor R3 could be chosen to make the collector currents equal if desired.

As stated before, for specificity in the previous descriptions of the exemplary embodiments of the invention, it was generally assumed that the pairs of transistors operating at different current densities have different areas and have substantially equal collector currents, though again, this is not a specific limitation of the invention, as transistors of the same area could be operated at different collector currents, or transistors of the different areas could be operated at different collector currents, all in the practice of the present invention. As only one example, it was pointed out before that for the embodiment of FIG. 2, the tail current of transistors Q3 and Q4 can be reduced to lower the flicker noise of the circuit at the expense of a minor increase in the overall wideband noise. Obviously this reduces the collector current for these two transistors.

In the embodiments described, NPN transistors have been used. In some situations it may be advantageous to use PNP transistors. Subject to the specifics of the semiconductor processing used to manufacture the circuit, either PNP or NPN transistors may lend themselves to better noise performance, especially flicker noise, or improved DC accuracy or more reliable manufacturing of the voltage reference. It is also possible to use a combination of PNP and NPN transistors to build the circuits of the present invention.

In the embodiment of the invention shown in FIG. 2, it will be noted that the voltage on the base of transistor Q3 is equal to the VBE of transistor Q2 plus the voltage across resistor R1. Consequently, transistor Q2 may be placed below resistor R1 rather than above the resistor, provided the base of transistor Q3 is coupled to the top of the series combination of the resistor R1 and the transistor Q2. Similarly, in the embodiment of FIG. 3, resistor R1 may be between transistors Q3 and Q4, or even above transistor Q3, provided the base of transistor Q5 is coupled to the top of the series combination of transistors Q3 and Q4 and resistor R1. A similar rearrangement is applicable to the embodiment of FIG. 4.

It is also possible to combine a portion of R2 and R3 into a single series resistor. It would be convenient to do this because the output voltage of the bandgap could be trimmed by altering the value of this combined resistor.

Figure 5:
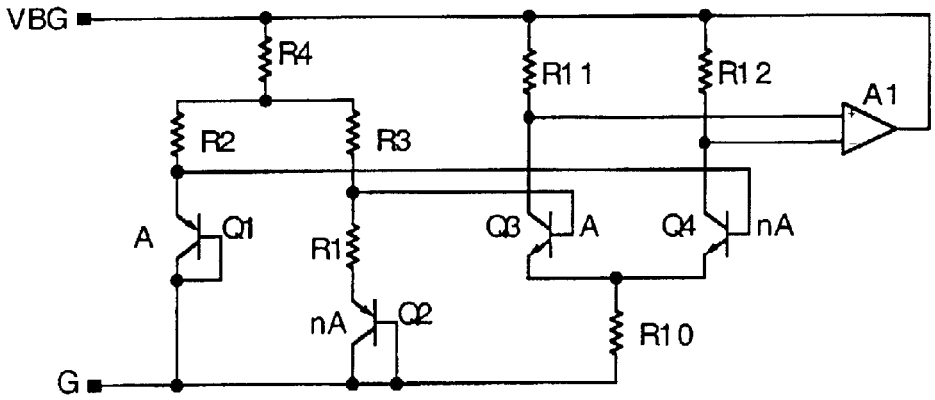
FIG. 5 is a further alternate embodiment of the present invention using a combination of transistors of differing conductivity types.

Now referring to FIG. 5, an embodiment similar to FIG. 2, but incorporating a number of alternatives may be seen. In particular, NPN transistors Q1 and Q2 of FIG. 2 have been replaced in FIG. 5 by PNP transistors, providing an embodiment using a combination of NPN and PNP transistors. Also the positions of transistor Q2 and resistor R1 have been reversed, as it is the series combination of transistor Q2 and resistor R1, not their position in the series combination, that is important. Finally, a portion of resistors R2 and R3 of FIG. 2 have been combined into a single series resistor R4, convenient for trimming the output voltage of the bandgap reference by altering the value of this combined resistor.

While certain preferred embodiments of the present invention have been disclosed and described herein, it will be understood by those skilled in the art that various changes in form and detail may be made therein without departing from the spirit and scope of the invention.

What is claimed is:

1. A reference having a bandgap reference output and a bandgap reference ground connection comprising:

first, second, third and fourth transistors, each having an emitter, a base and a collector;

the first and second transistors each being diode connected;

the third and fourth transistors having a common emitter connection;

a resistor in series with the second transistor;

the first transistor and the series combination of the second transistor and the resistor each being resistively biased between the bandgap reference output and the bandgap reference ground connection in relation to the relative sizes of the first and second transistors to operate the first transistor at a higher current density than the second transistor;

the bases of the fourth and third transistors being coupled to be responsive to the difference in voltage across the first transistor and the series combination of the second transistor and the resistor, respectively, the third and fourth transistors each being resistively biased in relation to the relative sizes of the third and fourth transistors to operate the third transistor at a higher current density than the fourth transistor;

the resistor and the first, second, third and fourth transistors being coupled to define a closed loop comprising the resistor, the difference in the base emitter voltages of the first and second transistors and the difference in the base emitter voltages of the third and fourth transistors; and, an amplifier having a differential input responsive to the difference in the voltages across the resistive biasing of the third and fourth transistors, and an output coupled to the bandgap reference output.

2. The reference of claim 1 wherein the third and fourth transistors are each resistively biased between the bandgap reference output and the bandgap reference ground connection.

3. The reference of claim 1 wherein the second and fourth transistors are larger than the first and third transistors, respectively.

4. The reference of claim 1 where the first and second transistors are of the same conductivity type as the third and forth transistors.

5. The reference of claim 1 where the first and second transistors are a different conductivity type than the third and forth transistors.

6. The reference of claim 1 wherein the third and fourth transistors are biased to operate at a lower current than the first and second transistors, respectively.

7. The reference of claim 1 wherein the second transistor is selectively resistively biased relative to the resistance of the resistor to result in a bandgap voltage output that is insensitive to temperature.

8. A reference having a bandgap reference output and a bandgap reference ground connection comprising:

first, second, third and fourth transistors, each having an emitter, a base and a collector;

the first and second transistors each being diode connected;

the third and fourth transistors being connected as a differential pair having a common emitter connection;

a resistor in series with the second transistor;

the first transistor and the series combination of the second transistor and the first resistor each being resistively biased between the bandgap reference output and the bandgap reference ground connection to operate the first transistor at a higher current density than the second transistor, the third and fourth transistors each being resistively biased to operate the third transistor at a higher current density than the fourth transistor;

the difference between the voltage across the first transistor and the voltage across the series combination of the first transistor and the resistor being coupled to the bases of the fourth and the third transistors as a differential input thereto; and, an amplifier having a differential input responsive to the difference in voltage across the third and fourth transistors, and an output coupled to the bandgap reference output.

9. The reference of claim 8 wherein the third and fourth transistors are each resistively biased between the bandgap reference output and the bandgap reference ground connection.

10. The reference of claim 8 wherein the second and fourth transistors are larger than the first and third transistors, respectively.

11. The reference of claim 8 where the first and second transistors are of the same conductivity type as the third and forth transistors.

12. The reference of claim 8 where the first and second transistors are a different conductivity type than the third and forth transistors.

13. The reference of claim 8 wherein the third and fourth transistors are biased to operate at a lower current than the first and second transistors, respectively.

14. The reference of claim 8 wherein the second transistor is selectively resistively biased relative to the resistance of the resistor to result in a bandgap voltage output that is insensitive to temperature.

15. A reference having a bandgap reference output and a bandgap reference ground connection comprising:

first, second, third, fourth, fifth and sixth transistors, each having an emitter, a base and a collector;

the first and second transistors each being diode connected;

the third and fourth transistors having a common emitter connection;

the fifth and sixth transistors each being diode connected, the fifth transistor being coupled in series with the first transistor and the sixth transistor being coupled in series with the second transistor;

a resistor in series with the second and sixth transistors;

the series combination of the first and fifth transistors and the series combination of the second and sixth transistors and the resistor each being resistively biased between the bandgap reference output and the bandgap reference ground connection in relation to the relative sizes of the first, second, fifth and sixth transistors to operate the first transistor at higher current density than the second transistor, and to operate the fifth transistor at a higher current density than the. sixth transistor;

the bases of the fourth and third transistors being coupled to be responsive to the difference in voltage across the series combination of the first and fifth transistors and the series combination of the second and sixth transistors and the resistor, respectively, the third and fourth transistors each being resistively biased in relation to the relative sizes of the third and fourth transistors to operate the third transistor at a higher current density than the fourth transistor;

the resistor and the first through the sixth transistors being coupled to define a closed loop comprising the resistor, the difference in the base emitter voltages of the first and second transistors, the difference in the base ernitter voltages of the third and fourth transistors and the difference in the base emitter voltages of the fifth and sixth transistors; and, an amplifier having a differential input responsive to the difference in the voltages across the resistive biasing of the third and fourth transistors, and an output coupled to the bandgap reference output.

16. The reference of claim 15 wherein the sixth transistor is larger that the fifth transistor.

17. The reference of claim 15 further comprised of seventh and eighth transistors, the seventh and eighth transistors each being diode connected, the seventh transistor being coupled in series with the third transistor and the eighth transistor being coupled in series with the fourth transistor so that the closed loop further comprises the difference in base emitter voltages of the seventh and eighth transistors.

18. The reference of claim 17 wherein the sixth and eighth transistors are larger that the fifth and seventh transistors, respectively.

19. A reference having a bandgap reference output and a bandgap reference ground connection comprising:

first, second, third, fourth, fifth and sixth transistors, each having an emitter, a base and a collector;

the first and second transistors each being diode connected;

the third and fourth transistors being connected as a differential pair having a common emitter connection;

the fifth and sixth transistors each being diode connected, the fifth transistor being coupled in series with the first transistor and the sixth transistor being coupled in series with the second transistor;

a resistor in series with the second and sixth transistors;

the series combination of the first and fifth transistors and the series combination of the second and sixth transistors and the resistor each being resistively biased between the bandgap reference output and the bandgap reference ground connection to operate the first and fifh transistors at higher current densities than the second and sixth transistors;

the third and fourth transistors each being resistively biased to operate the third transistor at a higher current density than the fourth transistor;

the difference between the voltage across the series combination of the first and fifth transistors and the voltage across the series combination of the first and sixth transistors and the resistor being coupled to the bases of the fourth and the third transistors as a differential input thereto; and, an amplifier having a differential input responsive to the difference in voltage across the third and fourth transistors, and an output coupled to the bandgap reference output.

20. The reference of claim 19 wherein the sixth transistor is larger that the fifth transistor.

21. The reference of claim 19 further comprised of seventh and eighth transistors, the seventh and eighth transistors each being diode connected, the seventh transistor being coupled in series with the third transistor and the eighth transistor being coupled in series with the fourth transistor, the voltage coupled to the bases of the fourth and the third transistors as a differential input thereto further including the voltage difference across the seventh and eighth transistors.

22. The reference of claim 21 wherein the sixth and eighth transistors are larger that the fifth and seventh transistors, respectively.

* * * * *